US011758943B2

(12) United States Patent
Ou

(10) Patent No.: US 11,758,943 B2
(45) Date of Patent: Sep. 19, 2023

(54) OIL LEAKAGE PROOF ELECTRONIC CIGARETTE WITH REPLACEABLE ATOMIZING CORE

(71) Applicant: GD Sigelei Electronic Tech Co., Ltd., Dongguan (CN)

(72) Inventor: Junbiao Ou, Dongguan (CN)

(73) Assignee: GD SIGELEI ELECTRONIC TECH CO., LTD., Dongguan (CN)

( * ) Notice: Subject to any disclaimer, the term of this patent is extended or adjusted under 35 U.S.C. 154(b) by 418 days.

(21) Appl. No.: 16/996,977

(22) Filed: Aug. 19, 2020

(65) Prior Publication Data

US 2021/0352963 A1 Nov. 18, 2021

(30) Foreign Application Priority Data

May 14, 2020 (CN) ..... 202020799453.6

(51) Int. Cl.

| | |
|---|---|
| ***A24F 40/40*** | (2020.01) |
| ***A24F 40/42*** | (2020.01) |
| ***A24F 40/10*** | (2020.01) |
| ***A24F 40/44*** | (2020.01) |
| ***A24F 40/50*** | (2020.01) |

(52) U.S. Cl.

CPC ..... *A24F 40/42* (2020.01); *A24F 40/10* (2020.01); *A24F 40/44* (2020.01); *A24F 40/50* (2020.01)

(58) Field of Classification Search

CPC ..... A24F 40/10; A24F 40/40; A24F 40/42; A24F 40/44; A24F 40/50

See application file for complete search history.

(56) References Cited

U.S. PATENT DOCUMENTS

| | | | | |
|---|---|---|---|---|
| 10,993,477 | B2 * | 5/2021 | Yamada | A61M 11/042 |
| 11,127,988 | B2 * | 9/2021 | Guo | H01M 50/284 |
| 11,324,253 | B2 * | 5/2022 | Liu | A24F 40/05 |
| 2015/0320115 | A1 * | 11/2015 | Liu | A24F 40/50 131/329 |
| 2021/0112866 | A1 * | 4/2021 | Li | A24F 40/42 |
| 2021/0186098 | A1 * | 6/2021 | Liu | A24F 40/10 |
| 2021/0260312 | A1 * | 8/2021 | Lacour-Gayet | B05B 17/0646 |

FOREIGN PATENT DOCUMENTS

| | | | | |
|---|---|---|---|---|
| WO | WO-2017143865 | A1 * | 8/2017 | A24B 15/167 |
| WO | WO-2018130023 | A1 * | 7/2018 | A24F 40/40 |
| WO | WO-2019239217 | A1 * | 12/2019 | A24F 40/05 |

* cited by examiner

*Primary Examiner* — Abdullah A Riyami
*Assistant Examiner* — Thang H Nguyen
(74) *Attorney, Agent, or Firm* — McClure, Qualey & Rodack, LLP

(57) ABSTRACT

The present invention is applicable to the technical field of electronic cigarettes, which provides an oil leakage proof electronic cigarette with replaceable atomizing core, including a cigarette holder, a housing, and a cartridge and a power supply unit arranged in the housing; the cigarette holder is detachably arranged at one end of the housing; the end of the housing away from the cigarette holder is provided with an air inlet; the cartridge includes a casing of the cartridge, an atomizing assembly provided in the housing, and a first end cover and a second end cover provided at both ends of the casing of the cartridge. The second end cover is provided with a first electrode circuit board, and both the first end cover and the second end cover are provided with air-guiding hole structures.

18 Claims, 6 Drawing Sheets

OIL LEAKAGE PROOF ELECTRONIC CIGARETTE WITH REPLACEABLE ATOMIZING CORE

TECHNICAL FIELD OF THE INVENTION

The present invention refers to the technical field of electronic cigarettes, and particularly relates to an oil leakage proof electronic cigarette with replaceable atomizing core.

BACKGROUND OF THE INVENTION

Electronic cigarette is an electronic product imitating cigarette. It is a product that allows users to smoke after ingredients like nicotine is turned into steam by means of such as atomization. At present, electronic cigarettes on the market are mainly divided into two categories: disposable electronic cigarettes and electronic cigarettes that can be oiled and rechargeable for repeated use.

The electronic cigarette, which can be used repeatedly by refilling oil, are bulky, difficult to carry and liable to oil leakage. And the disposable electronic cigarette has an integrated structure, which is small in size and easy to carry, and is popular with the majority of consumers. However, at present, such a small and portable electronic cigarette in the market is merely disposable, and it would be discarded after it has been used for once, which incurs the wasting of resources and a high cost of use.

It can be seen that the existing electronic cigarette technology has the technical problems of wasting resources and high costs of use.

SUMMARY OF THE INVENTION

The purpose of the embodiments of the present invention is to provide an oil leakage proof electronic cigarette with replaceable atomizing core, aiming to solve the technical problems of the wasting of resources and a high cost of use in the existing electronic cigarette technology.

The embodiments of the present invention are implemented as follow, and the electronic cigarette includes: a cigarette holder, a housing and a power supply unit, the cigarette holder is detachably provided at one end of the housing, the end of the housing away from the cigarette holder is provided with an air inlet; the cartridge includes a casing of the cartridge, an atomizing assembly provided in the casing of the cartridge, and a first end cover and a second end cover provided at both ends of the casing of the cartridge, the second end cover is provided with a first electrode circuit board, both the first end cover and the second end cover are provided with air-guiding hole structures, the cartridge is detachably arranged in one end of the housing close to the cigarette holder, and the first end cover is in contact with the cigarette holder; the power supply unit is used to supply power to the atomizing assembly through the first electrode circuit board.

Preferably, the casing of the cartridge is a tubular structure, and the first end cover and the second end cover are made of silicone material, and both the first end cover and the second end cover are in an interference-fit with the casing of the cartridge.

Preferably, the atomizing component includes a heating coil, an oil-guiding cotton and an atomizing tube; two ends of the atomizing tube respectively are connected with the air-guiding hole structure on the first end cover and the second end cover; the oil-guiding cotton is used for guiding the smoke oil in the cartridge into the atomizing tube; the heating coil is connected to the first electrode circuit board, and the heating coil is used to atomize the smoke oil.

Preferably, an oil-guiding hole is provided on the peripheral surface of the atomizing tube; the oil-guiding cotton passes through the oil-guiding hole, and both ends thereof are located outside of the atomizing tube; the heating coil is arranged in the atomizing tube and is wound on the oil guiding cotton.

Preferably, the power supply unit includes an electrode, a second electrode circuit board, and a battery, and the electrode is provided on the second electrode circuit board; the housing includes an outer housing, a first positioning sleeve and a second positioning sleeve, the first positioning sleeve and the second positioning sleeve are disposed in the housing, the second electrode circuit board is disposed between the first positioning sleeve and the second positioning sleeve, the cartridge is arranged in the first positioning sleeve, the electrode is connected to the first electrode circuit board, the battery is arranged in the second positioning sleeve, and the battery is connected to the second electrode circuit board.

Preferably, the power supply unit further includes an silicone electrode pad; the silicone electrode pad is sleeved on the electrode and is connected with the second electrode circuit board, the silicone electrode pad and the second electrode circuit board are disposed between the first positioning sleeve and the second positioning sleeve together, and the silicone electrode pad is connected with one end surface of the first positioning sleeve, and the second electrode circuit board is connected with one end surface of the second positioning sleeve.

Preferably, the power supply unit further includes a power supply circuit board and a power supply connector, the power supply circuit board connects the battery and the power supply connector, and the power supply connector is used to connect an external power supply.

Preferably, the cigarette holder is also provided with a protective member, the protective member is disposed on an end of the cigarette holder close to the cartridge, and the protective member is used to prevent cigarette oil from entering the cigarette holder.

Preferably, the protective member is made of needle punched cotton, and the protection member is provided with a vent hole.

Preferably, the electronic cigarette further includes an airflow switch; the airflow switch is provided in the power supply circuit, and is used to control the conduction between the atomizing component and the power supply unit by sensing airflow.

The oil leakage proof electronic cigarette with replaceable atomizing core disclosed in the embodiments of the present invention allows that the cartridge in the electronic cigarette can be replaced by detachably installing the cigarette holder and the cartridge on the housing, thereby saving the cost of the electronic cigarette. In addition, the first end cover of the cartridge is in contact with the cigarette holder, which ensures the sealing between the cartridge and the cigarette holder, and avoids oil leakage and smoke leakage.

The drawings include following integers:

1—Cigarette holder;
11—Protective member;
2—Housing;
21—Outer housing;
22—First positioning sleeve;
23—Second positioning sleeve;
24—Connecting ring;
25—Plastic tail;
26—Air inlet
3—Cartridge;
31—First end cover;
32—Second end cover;
33—Casing of the cartridge;
34—First electrode circuit board;
341—Positive electrode;
342—Negative electrode;
35—Atomizing assembly;
351—Heating coil;
352—Oil-guiding cotton;
353—Atomization tube;
41—Electrode;
42—Second electrode circuit board;
43—Battery;
44—Silicone electrode pad;
45—Power supply circuit board;
46—Power supply connector;
47—air-guiding hole structure;
48—oil guiding hole;
49—airflow switch

DETAILED DESCRIPTION OF THE ILLUSTRATED EMBODIMENTS

In order to make the objectives, technical solutions and advantages of the present invention more clear, the present invention will be further described in detail below in conjunction with the accompanying drawings and embodiments. It should be understood that the specific embodiments described herein are only used to explain the present invention, and are not intended to limit the present invention.

The specific implementation of the present invention will be described in detail below in conjunction with specific embodiments.

Figure 1:
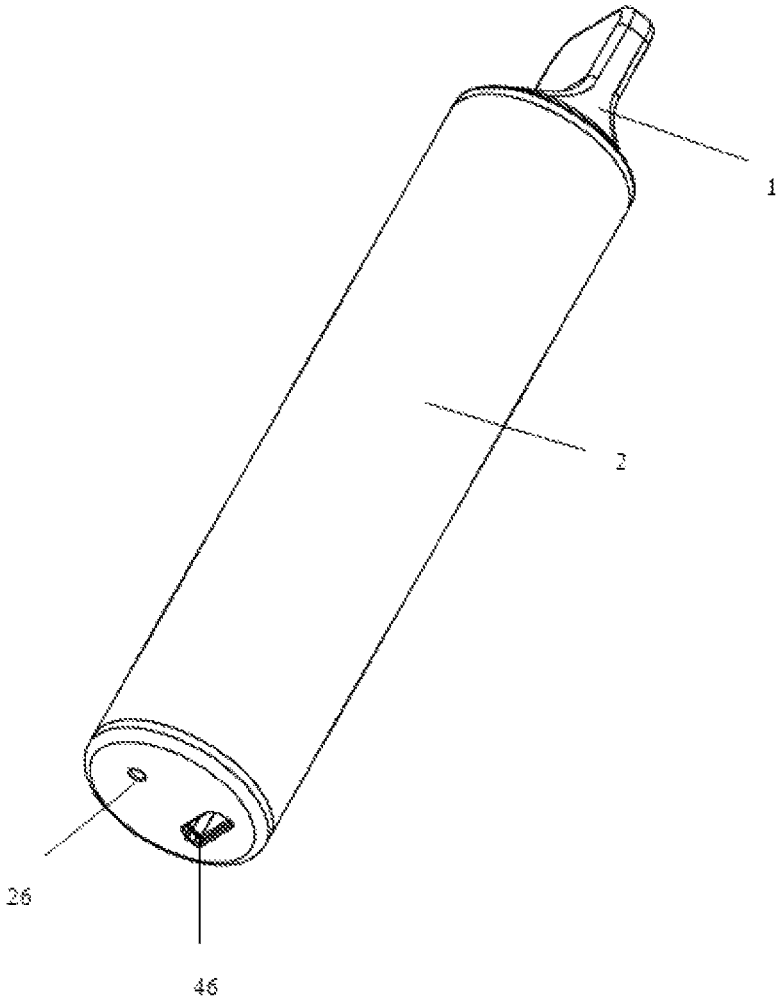
FIG. 1 is a three-dimensional structural schematic diagram of an electronic cigarette with an oil anti-leakage and replaceable atomizing core provided by an embodiment of the present invention.
Figure 2:
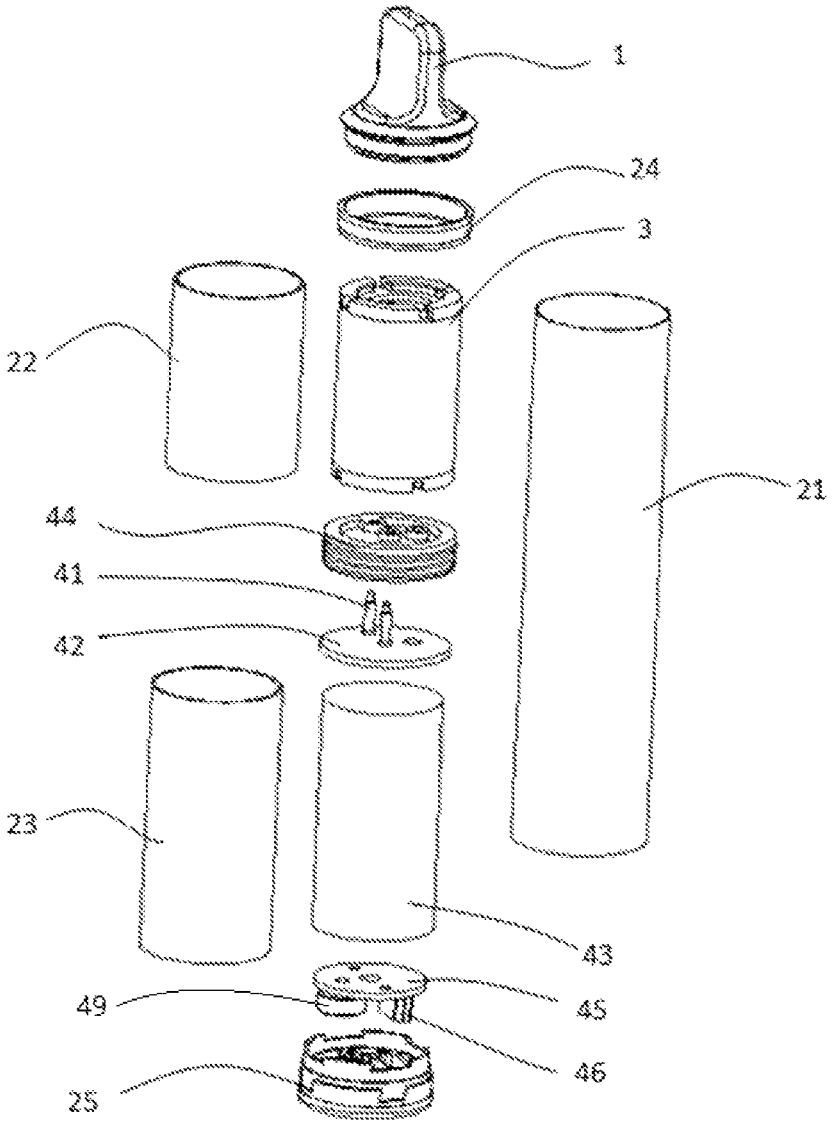
FIG. 2 is an exploded view of an oil leakage proof electronic cigarette with replaceable atomizing core provided by an embodiment of the present invention.
Figure 3:
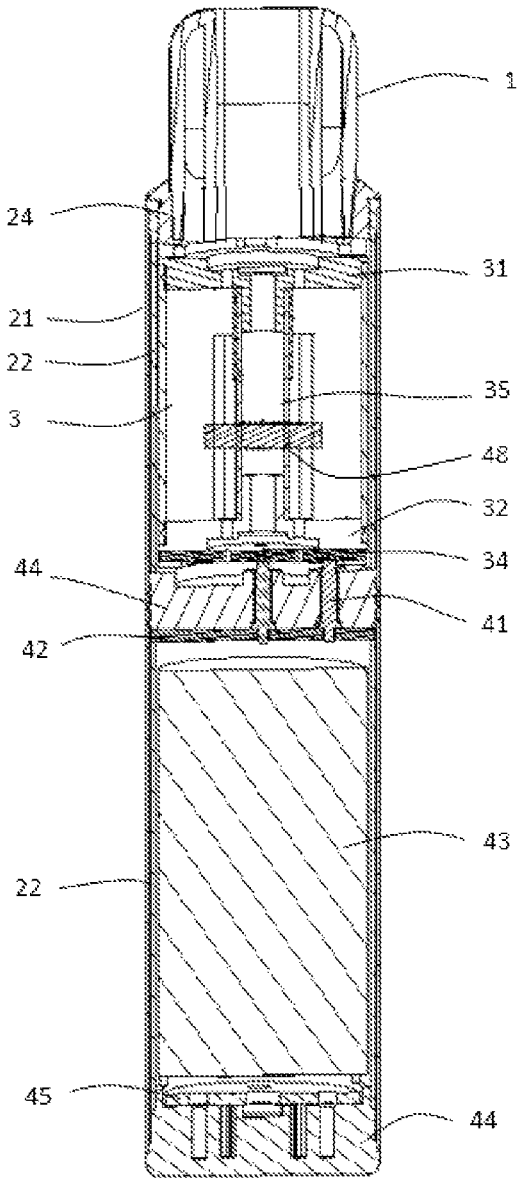
FIG. 3 is a cross-sectional view of an oil leakage proof electronic cigarette with replaceable atomizing core provided by an embodiment of the present invention.

As shown in FIGS. 1-3, the structural schematic diagram of an oil leakage proof electronic cigarette with replaceable atomizing core provided by the embodiments of the present invention is disclosed, in which the electronic cigarette includes a cigarette holder 1, a housing 2, and a cartridge 3 and a power supply unit arranged in the housing 2, the cigarette holder 1 is detachably provided at one end of the housing 2, the end of the housing 2 away from the cigarette holder 1 is provided with an air inlet 26; the cartridge 3 includes a casing of the cartridge 33, an atomizing assembly 35 provided in the casing of the cartridge 33, and a first end cover 31 and a second end cover 32 provided at both ends of the casing of the cartridge 33, the second end cover 32 is provided with a first electrode circuit board 34, both the first end cover 31 and the second end cover 32 are provided with air-guiding hole structures 47, the cartridge 3 is detachably arranged at the end of the housing 2 close to the cigarette holder 1, and the first end cover 31 is in contact with the cigarette holder 1; the power supply unit is used to supply power to the atomizing assembly 35 through the first electrode circuit board 34.

In the embodiment of the present invention, the housing 2 is used to load other components constituting the electronic cigarette, this embodiment does not limit the specific shape and structure of the housing 2, the housing 2 of a circular tube is taken as an example for description, but it is not limited to this, the air inlet 26 on the housing 2 is used to allow the outside air to enter the electronic cigarette from the air inlet 26, so as to balance the internal pressure of the electronic cigarette when the user smokes the electronic cigarette.

In the embodiment of the present invention, the specific structure of the cigarette holder 1 is not limited, and the detachable connection between the cigarette holder 1 and the housing 2 may be a snap connection or a screw connection, but it is not limited thereto, for example, a connection ring 24 could be fixed on the housing 2, and the cigarette holder 1 can be detachably connected to the housing 2 by snap-fitting with the connection ring 24, this embodiment does not limit the clamping structure between the cigarette holder 1 and the connecting ring 24, for example, the connecting ring 24 may be a material with a certain elasticity, the outer periphery of the cigarette holder 1 is provided with a clamping protrusion, and the inner periphery of the connecting ring 24 is provided with a clamping slot.

Figure 4:
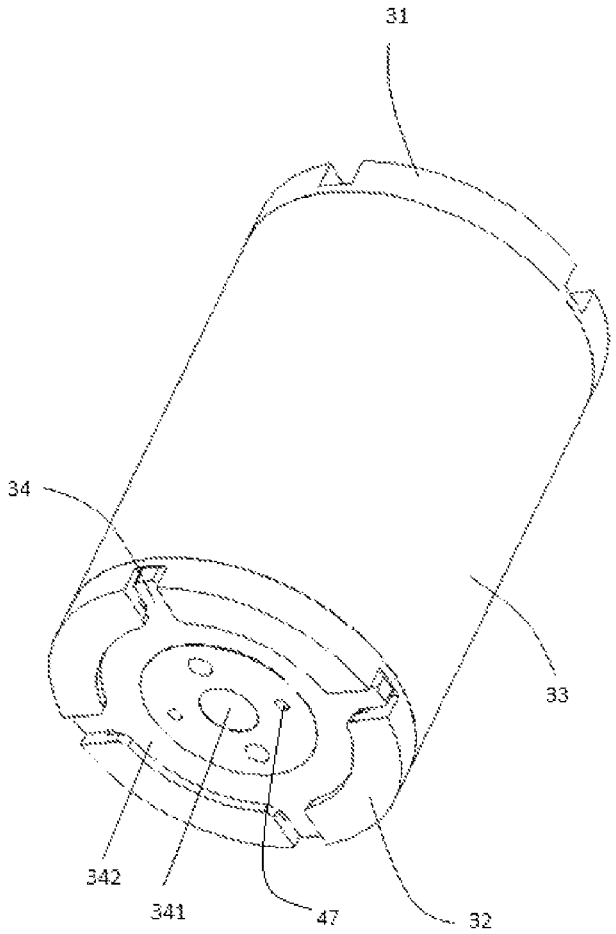
FIG. 4 is a schematic structure view of a cartridge provided by an embodiment of the present invention.
Figure 5:
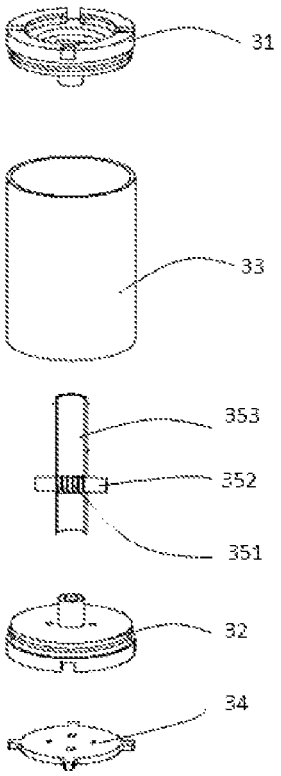
FIG. 5 is an explosion diagram of a cartridge provided by an embodiment of the present invention.

In the embodiment of the present invention, as shown in FIGS. 4-5, it is a schematic structural view of a cartridge 3, the cartridge 3 is used to store and atomize the smoke oil, the casing of the cartridge 33 of a tubular structure is taken as an example for description, but it is not limited to this, For example, the casing of the cartridge 33 may be a thin-walled PVC tube, and the first end cover 31 and the second end cover 32 may be made of silicone material. Both the first end cover 31 and the second end cover 32 are in an interference-fit with the two ends of the thin-walled PVC tube. The first end cover 31, the second end cover 32 and the cartridge case form a cavity structure, and the smoke oil and the atomization assembly are arranged in the cavity structure. The air-guiding hole structures 47 on the first end cover 31 and the second end cover 32 are used for guiding the atomized smoke oil into the cigarette holder through the cartridge 3 and then into the user's mouth when the user smokes the electronic cigarette. In addition, the first end cover 31 is arranged to be silicone material, and the cigarette holder 1 snapped into one end of the connecting ring 24 is in contact with the first end cover 31 so that a tight connection between the cigarette holder 1 and the cartridge 3 is achieved, thereby avoiding the atomized cigarette oil leaking from the connection between cigarette holder 1 and cartridge 3.

In the embodiment of the present invention, the function of the atomizing assembly 35 in the cartridge 3 is to atomize the smoke oil, and the specific structure of the atomizing assembly 35 is not limited in this embodiment, For example, the atomizing assembly 35 may include a heating coil 351, an oil guiding cotton 352, and an atomizing tube 353, wherein, the atomizing tube 353 may be a fiberglass tube, and both ends of the atomizing tube 353 are connected with the air-guiding hole structures 47 on the first end cover 31 and the second end cover 35, meanwhile, an oil-guiding hole 48 is provided on the peripheral surface of the atomizing tube 353, the oil-guiding cotton 352 passes through the oil-guiding hole 48, the two ends of the oil-guiding cotton 352 are located outside the atomizing tube 353, and the middle portion thereof is located inside the atomizing tube 353; when the cartridge 3 is filled with smoke oil, both ends of the oil guiding cotton 352 are immersed in the smoke oil, and the smoke oil enters the atomizing tube 353 along the oil-guiding cotton 352, thereby conducting the smoke oil outside the atomizing tube 353 into the atomizing tube 353, and the heating coil 351 is arranged in the atomizing tube 353 and is wound around the portion of the oil guiding cotton 352 located in the atomizing tube 353; the heating coil 351 is connected to the first electrode circuit board 34, and the heating coil 351 generates heat when energized, thereby atomizing the smoke oil on the oil-guiding cotton 352. The first electrode circuit board 34 is provided on the second end cover 32, and the first electrode circuit board 34 is also correspondingly provided with an air hole structure, the power supply unit is connected with the first electrode circuit board 34, and a positive electrode 341 and a negative electrode 342 are provided on the first electrode circuit board 34. This embodiment does not limit the specific structure of the first electrode circuit board 34, and the first electrode circuit board 34 is used to power supply connection between the power supply unit and the heating coil 351.

In the embodiment of the present invention, the power supply unit is disposed in the housing 2 near one end of the second end cover 32 of the cartridge 3, this embodiment does not limit the specific structure of the power supply unit, for example, the power supply unit may include an electrode 41, a second electrode circuit board 42, and a battery 43, wherein the electrode 41 is disposed on the second electrode circuit board 42, this embodiment does not limit the circuit structure on the second electrode circuit board 42. The second electrode circuit board 42 is used to realize the power supply connection between the electrode 41 and the battery 43. Preferably, the battery 43 may be a rechargeable battery, and the power supply unit may further include a power circuit board 45 and a power connector 46, the power circuit board 45 is used to realize the charging connection between the power connector 56 and the battery 43. This embodiment does not limit the circuit structure on the power circuit board 45, and the power connector 46 is used to connect an external power source. For example, the power connector 46 may be an interface like micro-USB, micro-USB TYPE-C, etc., but it is not limited thereto. Since the cartridge 3 is detachably disposed in the housing 2, in order to facilitate the replacement of the cartridge 3, the electrode 41 is in contact with the first electrode circuit board 34, the electrode 41 is fixed in the housing 2 along with the second electrode circuit board 42, in this way, when the cartridge 3 is installed in the housing 2, the positive electrode 341 and the negative electrode 342 on the first electrode circuit board 34 are connected to the electrode 41 respectively, this embodiment does not limit the specific fixing method of the electrode 41 in the housing 2. Preferably, the housing 2 may include a housing 21, a first positioning sleeve 22 and a second positioning sleeve 23, the housing 21 may be made of thin-walled steel pipe, and the first positioning sleeve 22 and the second positioning sleeve 23 may be PVC material, but it is not limited to this. When the housing 21 is of a tubular structure, the housing 2 may further include a plastic tail 25, which is disposed on the end of the housing 2 away from the suction nozzle 1, and the air inlet 26 is provided on the plastic tail 25. The plastic tail 25 is installed on the housing 21 via interference-fitting method, and the end of the plastic tail 25 installed inside the housing 2 is in contact with the second positioning sleeve 23. Wherein, the first positioning sleeve 22 and the second positioning sleeve 23 are arranged in the housing 21, and the second electrode circuit board 42 is arranged between the first positioning sleeve 22 and the second positioning sleeve 23 in the housing 21, the cartridge 3 is disposed in the first positioning sleeve 22, and the battery 43 is disposed in the second positioning sleeve 23. Preferably, in order to prevent a short circuit between the second electrode circuit board 42 and the housing 21, the power supply unit may further include an electrode silicone pad 44, the electrode silicone pad 44 is sleeved on the electrode 41 and is in contact with the second electrode circuit board 42, so that the electrode silicone pad 44 and the second electrode circuit board 42 are arranged between the first positioning sleeve 22 and the second positioning sleeve 23 together, and the electrode silicone pad 44 is in contact with one end surface of the first positioning sleeve 22, and the second electrode circuit board 42 is in contact with the first end surface of the second positioning sleeve 23, thereby realizing the fixing of the second electrode circuit board 42 in the housing 21, moreover, in the installation and fixation of the second electrode circuit board 42, the first positioning sleeve 22 and the second positioning sleeve 23 can realize the installation positioning of the second electrode circuit board 42. In order to further achieve the fixing of the second electrode circuit board 42 in the housing 21, the position where the electrode silicone pad 44 is installed in the housing 21 and the outer peripheral surface of the electrode silicone pad 44 are provided with a cooperating clamping structure (not shown in the figure), for example, For example, one of the housing 21 and the electrode silicone pad 44 is provided with a snap protrusion, and the other is provided with a snap slot. In addition, in order to ensure that the air flow entering the electronic cigarette from the air inlet 26 smoothly enters the cartridge 3, the battery 43 is matched with gap of the second positioning sleeve 22, and the power circuit board 45, the second electrode circuit board 42 and the electrode silicone pad 44 are all equipped with air-guiding hole structures 47.

The embodiment of the present invention provides an oil leakage proof electronic cigarette with replaceable atomizing core, which realizes the replacement of the cartridge 3 in the electronic cigarette by detachably installing the cigarette holder 1 and the cartridge 3 on the housing 2, thereby saving the cost of the electronic cigarette, moreover, the first end cover 31 of the cartridge 3 is made of silicone material, and the first end cover 31 of the cartridge 3 is arranged to be in contact with the cigarette holder 1 to ensure the sealing between the cartridge 3 and the cigarette holder 1 and to avoid the leakage of oil and smoke. Furthermore, the cartridge 3 is arranged to be a cavity structure formed by a thin-walled PVC pipe and two silicone end covers. Through an interference-fit between the silicone end cover and the thin-walled PVC pipe, it can not only achieve the sealing of the cartridge 3, but also facilitate the separation of the silicone end cover and the thin-walled PVC pipe to carry out maintenance and replacement of the atomizing assembly 35 inside the cartridge 3. Additionally, in this embodiment, the housing 2 is configured to include a housing 21, a first positioning sleeve 22, and a second positioning sleeve 23, and a second electrode circuit board 42 provided with an electrode 41 is disposed between the first positioning sleeve 22 and the second positioning sleeve 23, which can realize the fixed installation of the second electrode circuit board 42 in the housing 2. When the electrode circuit board 42 is installed, the first positioning sleeve 22 and the second positioning sleeve 23 may be used to implement the positioning of the second electrode circuit board 42.

Figure 6:
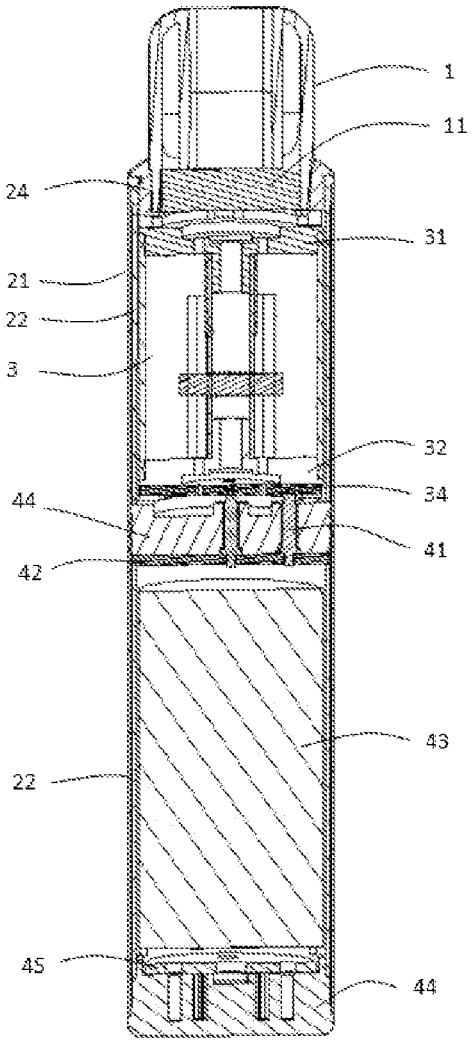
FIG. 6 is a cross-sectional view of an electronic cigarette provided with a protective member in a cigarette holder provided by an embodiment of the present invention.

As shown in FIG. 6, in another embodiment of the present invention, the cigarette holder 1 is further provided with a protective member 11, which is disposed on the end of the cigarette holder 1 close to the cartridge 3, and the protective member is used to prevent the smoke oil from entering the cigarette holder 1.

In the embodiment of the present invention, due to the oil is prone to splatter when the electronic cigarette is in use, and the cigarette oil easily enters the mouth of the user through the cigarette holder 1 when the user smokes, and the protective member 11 is arranged on one end of the cigarette holder 1 close to the cartridge 3, it can effectively prevent the smoke oil from entering the cigarette holder 1 when there is an oil splashing, thereby avoiding it entering the user's mouth, for example, the protective member 11 may be made of needle punched cotton, but it is not limited to this, meanwhile, in order to ensure the circulation of airflow in the electronic cigarette, the protective cotton may also be provided with a small vent hole (not shown in the figures).

The embodiment of the present invention provides an electronic cigarette with an anti-leakage and replaceable atomizing core. By providing a protective member 11 on the cigarette holder 1, the smoke oil can be effectively prevented from entering the user's mouth in the event of oil splashing, thereby improving the security of using the electronic cigarette.

In another embodiment of the present invention, the electronic cigarette further includes an airflow switch 49; the airflow switch 49 is provided in the power supply circuit for controlling the conduction between the atomizing component and the power supply unit by sensing airflow.

In the embodiment of the present invention, the specific structure of the airflow switch 49 is not limited, for example, the airflow switch 49 is provided with an air pressure sensor, the air pressure sensor is provided on the air intake channel of the electronic cigarette, when the user smokes the electronic cigarette, the external air enters the electronic cigarette through the air inlet, the airflow switch 49 closes up when the air flow is sensed. The power supply unit and the heating coil 351 in the atomizing assembly 35 forms a loop, and the heating coil 351 is energized to generate heat, thereby atomizing the smoke oil on the oil-guiding cotton 352, and the atomized smoke oil passes through the air-guiding hole structures 47 on the end cover 31 with the airflow, then enters the cigarette holder 1 and after then gets to the mouth of the user, and the airflow switch 49 automatically opens when it cannot sense the circulation of gas.

According to an embodiment of the present invention, an oil leakage proof electronic cigarette with replaceable atomizing core is provided with an airflow switch 49 in the electronic cigarette, the airflow switch 49 is closed only when the user smokes the electronic cigarette. The heating coil 351 in the atomizing assembly 35 and the power supply unit is turned on to form a loop, and the heating coil 351 generates heat to avoid loss caused by the continuous operation of the atomizing component 35 and thereby improve the service life of the atomizing component 35.

An embodiment of the present invention provides an oil leakage proof electronic cigarette with replaceable atomizing core. When in use, the user smokes the electronic cigarette through the cigarette holder, the outside air enters the electronic cigarette through the air inlet, and the airflow switch 49 closes up while sensing the gas flow. The heating coil 351 and the power supply unit are connected to form a loop, and the heating coil 351 is energized to generate heat to atomize the smoke oil on the oil-guiding cotton 352. The atomized smoke oil passes through the first end cover 31 with the gas in the atomizing tube 353, and then enters the cigarette holder 1 through the protective member 11 and after then gets to the mouth of the user. When the user does not smoke, the airflow switch 49 is turned off, and then the atomizing assembly 35 does not work.

The above are only the preferred embodiments of the present invention and are not intended to limit the present invention. Any modification, equivalent replacement and improvement made within the spirit and principle of the present invention should be included in the protection scope of the present invention.

The invention claimed is:

1. An oil leakage proof electronic cigarette with replaceable atomizing core, including a cigarette holder, a housing, a cartridge and a power supply unit provided in the housing, wherein the cigarette holder is detachably provided at one end of the housing;

an end of the housing away from the cigarette holder is provided with an air inlet;

the cartridge includes a casing of the cartridge, an atomizing assembly provided in the casing of the cartridge, and a first end cover and a second end cover provided at both ends of the casing of the cartridge; the second end cover is provided with a first electrode circuit board, both the first end cover and the second end cover are provided with air-guiding hole structures, the cartridge is detachably arranged in one end of the housing close to the cigarette holder, and the first end cover is in contact with the cigarette holder;

the power supply unit is used to supply power to the atomizing assembly through a first electrode circuit board.

2. The oil leakage proof electronic cigarette with replaceable atomizing core according to the claim 1, wherein the casing of the cartridge is of a tubular structure, and the first end cover and the second end cover are made of silicone material, and both the first end cover and the second end cover are in an interference-fit with the casing of the cartridge.

3. The oil leakage proof electronic cigarette with replaceable atomizing core according to the claim 1, wherein an atomizing assembly includes a heating coil, an oil-guiding cotton and an atomizing tube;

both ends of the atomizing tube are respectively connected with the air-guiding hole structures on the first end cover and the second end cover;

the oil-guiding cotton is used for guiding oil in the cartridge into the atomizing tube;

the heating coil is connected to a first electrode circuit board, and the heating coil is used to atomize oil.

4. The oil leakage proof electronic cigarette with replaceable atomizing core according to the claim 3, wherein an oil-guiding hole is provided on peripheral surface of the atomizing tube;

the oil-guiding cotton passes through the oil-guiding hole, and both ends thereof are located outside the atomizing tube;

the heating coil is arranged in the atomizing tube and is wound around the oil-guiding cotton.

5. The oil leakage proof electronic cigarette with replaceable atomizing core according to the claim 1, wherein the power supply unit includes an electrode, a second electrode circuit board, and a battery, and the electrode is provided on a second electrode circuit board;

the housing includes an outer housing, a first positioning sleeve and a second positioning sleeve; the first positioning sleeve and the second positioning sleeve are disposed in the housing, the second electrode circuit board is disposed between the first positioning sleeve and the second positioning sleeve, the cartridge is arranged in the first positioning sleeve, the electrode is connected to the first electrode circuit board, the battery is arranged in the second positioning sleeve, and the battery is connected to the second electrode circuit board.

6. The oil leakage proof electronic cigarette with replaceable atomizing core according to the claim 5, wherein the power supply unit further includes an silicone electrode pad;

the silicone electrode pad is sleeved on the electrode and is connected with the second electrode circuit board, both the silicone electrode pad and the second electrode circuit board are disposed between the first positioning sleeve and the second positioning sleeve, and the silicone electrode pad is connected with one end surface of the first positioning sleeve, and the second electrode circuit board is connected with one end surface of the second positioning sleeve.

7. The oil leakage proof electronic cigarette with replaceable atomizing core according to the claim 5, wherein the power supply unit further includes a power supply circuit board and a power supply connector, the power supply circuit board connects the battery and the power supply connector, and the power supply connector is used to connect to an external power supply.

8. The oil leakage proof electronic cigarette with replaceable atomizing core according to the claim 1, wherein the cigarette holder is also provided with a protective member, the protective member is disposed on an end of the cigarette holder close to the cartridge, and the protective member is used to prevent cigarette oil from entering the cigarette holder.

9. The oil leakage proof electronic cigarette with replaceable atomizing core according to the claim 8, wherein the protective member is made of needle punched cotton, and the protective member is provided with a vent hole.

10. The oil leakage proof electronic cigarette with replaceable atomizing core according to claim 1, wherein the electronic cigarette further includes an airflow switch; the airflow switch is provided in the power supply circuit, and is used to control connection between the atomizing assembly and the power supply unit by sensing airflow.

11. The oil leakage proof electronic cigarette with replaceable atomizing core according to claim 2, wherein the electronic cigarette further includes an airflow switch; the airflow switch is provided in the power supply circuit, and is used to control connection between the atomizing assembly and the power supply unit by sensing airflow.

12. The oil leakage proof electronic cigarette with replaceable atomizing core according to claim 3, wherein the electronic cigarette further includes an airflow switch; the airflow switch is provided in the power supply circuit, and is used to control connection between the atomizing assembly and the power supply unit by sensing airflow.

13. The oil leakage proof electronic cigarette with replaceable atomizing core according to claim 4, wherein the electronic cigarette further includes an airflow switch; the airflow switch is provided in the power supply circuit, and is used to control connection between the atomizing assembly and the power supply unit by sensing airflow.

14. The oil leakage proof electronic cigarette with replaceable atomizing core according to claim 5, wherein the electronic cigarette further includes an airflow switch; the airflow switch is provided in the power supply circuit, and is used to control connection between the atomizing assembly and the power supply unit by sensing airflow.

15. The oil leakage proof electronic cigarette with replaceable atomizing core according to claim 6, wherein the electronic cigarette further includes an airflow switch; the airflow switch is provided in the power supply circuit, and is used to control connection between the atomizing assembly and the power supply unit by sensing airflow.

16. The oil leakage proof electronic cigarette with replaceable atomizing core according to claim 7, wherein the electronic cigarette further includes an airflow switch; the airflow switch is provided in the power supply circuit, and is used to control connection between the atomizing assembly and the power supply unit by sensing airflow.

17. The oil leakage proof electronic cigarette with replaceable atomizing core according to claim 8, wherein the electronic cigarette further includes an airflow switch; the airflow switch is provided in the power supply circuit, and is used to control connection between the atomizing assembly and the power supply unit by sensing airflow.

18. The oil leakage proof electronic cigarette with replaceable atomizing core according to claim 9, wherein the electronic cigarette further includes an airflow switch; the airflow switch is provided in the power supply circuit, and is used to control connection between the atomizing assembly and the power supply unit by sensing airflow.

* * * * *